US006887048B2

(12) United States Patent
Hirata et al.

(10) Patent No.: US 6,887,048 B2
(45) Date of Patent: May 3, 2005

(54) LIQUID PUMP AND SEALING MECHANISM

(75) Inventors: Ryosuke Hirata, Iwai (JP); Yoji Mori, Ichikawa (JP)

(73) Assignee: World Chemical Co, Ltd., Tokyo (JP)

( * ) Notice: Subject to any disclaimer, the term of this patent is extended or adjusted under 35 U.S.C. 154(b) by 52 days.

(21) Appl. No.: 10/379,550

(22) Filed: Mar. 6, 2003

(65) Prior Publication Data

US 2003/0175136 A1 Sep. 18, 2003

(30) Foreign Application Priority Data

Mar. 15, 2002 (JP) ..... P2002-071518

(51) Int. Cl.[7] ..... F04D 29/14
(52) U.S. Cl. ..... 417/423.11; 277/378; 415/230
(58) Field of Search ..... 415/174.3, 231, 415/230; 417/423.11; 277/378, 433

(56) References Cited

U.S. PATENT DOCUMENTS 3,137,237 A 6/1964 Zagar et al.
4,915,579 A * 4/1990 Whittier et al. ..... 415/171.1
5,261,786 A * 11/1993 Sidelko ..... 415/171.1
5,580,215 A 12/1996 Sidelko et al.
5,816,784 A * 10/1998 Postuchow et al. .... 417/423.11

FOREIGN PATENT DOCUMENTS

DE 4002245 * 8/1991
FR 2 563 583 A 10/1985
JP 59-190577 * 10/1984

* cited by examiner

*Primary Examiner*—Michael Koczo, Jr.
(74) *Attorney, Agent, or Firm*—Roylance, Abrams, Berdo & Goodman L.L.P.

(57) ABSTRACT

A liquid pump has a sealing mechanism utilizing magnets. The sealing mechanism includes an annular rotating seal attached to the lower surface of a rotary base member fixed to the motor rotating shaft. Additionally, a flexible stationary seal is joined and separated with respect to the rotating seal. Movable magnets are disposed on the rotary base and are adapted to be displaced by centrifugal force due to a rotation of the rotary base member. A stationary magnet is disposed on the upper-surface side of a vertical sliding member to which the flexible stationary seal is fixed. The flexible stationary seal utilized has a cylindrical body. At the upper and lower end portions and the side surface portion, connecting portions to the stationary and movable members are formed. The middle portion has an elastic portion is formed on it.

16 Claims, 8 Drawing Sheets

LIQUID PUMP AND SEALING MECHANISM

FIELD OF THE INVENTION

The present invention relates to a liquid pump using an electric motor as a driving source, and more particularly, it relates to a liquid pump having a sealing mechanism utilizing magnets.

BACKGROUND OF THE INVENTION

In a liquid pump, in order to prevent a liquid from intruding into a motor casing from the side of a pump casing through a rotating shaft, a bearing portion of the rotating shaft is provided with a sealing mechanism for disposing a mechanical seal or a packing.

In a sealing mechanism located at the circumference of the rotating shaft, the sealing members are always in contact with the rotating shaft irrespective of the operating state or non-operating state of an electric motor and, therefore, easily wear down and impose a heavy maintenance burden.

In addition, in a liquid pump, depending on the usage place and application, not only the liquid but also minute solids may intrude into the circumference of the rotating shaft. Consequently, in the prior mechanism for sealing at the circumference of the rotating shaft, sealing members are easily damaged.

In view of the above circumstances, sealing mechanisms utilizing electromagnets have been proposed and carried out. For example, Japanese Patent Publication No. H01-43159 teaches a construction wherein a ring seal is fixed in a brim shape to a rotating shaft and a ring seal is attached to a cylindrical supporting body disposed in a manner shift-able in the axial direction of the rotating shaft. Both are opposed to each other The cylindrical supporting body is operated by an electromagnet. When an electric motor is in operation, by turning on the effect of the electromagnet, the cylindrical supporting body is shifted to closely fit both ring seals to create a sealing state, and when an electric motor is not in operation, by turning off the effect of the electromagnet, the cylindrical supporting body is restored by a spring or the like to release close fitting between both ring seals.

On the other hand, Japanese Patent Publications No. S62-46717 and Japanese Patent Publication No. S62-49477 teaches a construction wherein joining and separation of opposed ring seals are controlled by centrifugal force produced by a rotation of a rotating shaft when an electric motor is in operation.

In addition to the above, a construction for sealing by utilizing centrifugal force produced by a rotation of a rotating shaft is disclosed in Japanese Unexamined Patent Publication No. H07-280105, etc. However, this is carried out by only mechanical structures and is different from the construction of the present invention.

Since, the sealing mechanism taught in the above-described Japanese Patent Publication No. H01-43159 has a construction wherein joining and separation of the opposed ring seals are carried out by turning on and off of the electromagnet, technical problems remain, including: (1) a power supply circuit for operating the electromagnet is required, which results in a high cost, moreover, (2) since power supply voltages are not uniform among countries and regions, an adjustment is required prior to utilization; (3) the space where the electromagnet is arranged requires water-tightness, which complicates the mechanism; and (4) since temperature of the watertight space rises due to heat generated by the electromagnet and condensation easily condenses in a stop state, there is a concern for malfunction.

On the other hand, Japanese Patent Publications No. S62-46717 and No. S62-49477, as described above, concerns a sealing mechanism in that joining and separation of the opposed ring seals are controlled by centrifugal force produced by a rotation of the rotating shaft when an electric motor is in operation. However, since all components are mechanically structured, technical problems remain, including: (1) accurate processing and assembling of members or operating adjustments are required; and, (2) a malfunction easily occurs when minute solid components, etc., intrude, and the maintenance burden is great.

In particular, in a prior sealing mechanism, an O-ring or an oil seal is required in a sliding portion for driving a sealing member up and down. However, in some cases, expansion, corrosion and the like due to chemicals exist in the sliding portion, and the sealing member cannot smoothly follow the movement of the rotating shaft due to frictional resistance. Consequently, the prior liquid pump has a problem of an increased maintenance burden.

SUMMARY OF THE INVENTION

The present invention has been made with the objective of solving the problems of the prior art liquid pumps, and provides a liquid pump having a sealing mechanism constructed so that; (1) in order to prevent the sealing members from wearing down, control can be performed so as to release the sealing when the rotating shaft is rotating; (2) no power source is required for seal control; (3) watertight-ness of a seal control portion can be easily maintained; (4) maintenance burden is relieved, and (5) the number of components is small, the mechanism is simple, and manufacturing costs can be reduced.

The foregoing objects are basically obtained by a liquid pump assembly having a sealing mechanism disposed in an air chamber located between an electric motor casing for an electric motor, a pump casing in which an impeller is fixed to the tip of a motor rotating shaft of the electric motor, and a pump chamber being enclosed in a watertight manner by a cylindrical frame. The sealing mechanism includes a pair of sealing members composed of an annular rotating seal and a flexible stationary seal. The pair of sealing members is disposed around the motor rotating shaft of the electric motor. Opening and closing of the pair of sealing members is controlled by the magnetic force of movable and stationary magnets. The magnets are displaced by rotation of the motor rotating shaft. The annular rotating sealing member is attached to the lower surface of a rotary base member fixed to the motor rotating shaft. The flexible stationary seal is opened and closed with respect to the annular rotating seal. The movable magnet, being displaced by a centrifugal force created due to a rotation of the rotary base member, is disposed in the rotary base member with the annular rotating seal. The stationary magnet is disposed on a upper-surface side of a vertical sliding member to which the flexible stationary seal is fixed.

Consequently, when the motor rotating shaft is stopped, with an N-pole and S-pole of the movable magnet at their respective original positions, an opposite pole of the stationary magnet is attracted and the vertical sliding member is upwardly drawn. As a result, an upper surface of the flexible stationary seal contacts a lower surface of the annular rotating seal to seal the air chamber. Alternatively, when the motor rotating shaft is rotating at least a predetermined number of rotations, the pair of sealing members are controlled so that the movable magnet is displaced from its position by centrifugal force. The same poles of the stationary magnet and of the movable magnet repel, and the vertical sliding member is depressed downward. Thus, the upper surface of the flexible stationary seal is separated from the lower surface of the annular rotating seal to release the seal of the air chamber.

The foregoing objects are also obtained by a liquid pump assembly having a sealing mechanism disposed in a space between an electric motor casing for an electric motor, a pump casing with an impeller fixed to the tip of a motor rotating shaft of the electric motor, and a pump chamber being enclosed in a watertight manner by a cylindrical frame. The sealing mechanism comprises a pair of sealing members composed of an annular rotating seal and flexible stationary seal. The pair of sealing members are around the motor rotating shaft of the electric motor. Joining and separating of the pair of sealing members is controlled by a magnetic force of stationary and movable magnets displaced by a rotation of the motor rotating shaft. The annular rotating sealing member is attached to the lower surface of a rotary base member fixed to the motor rotating shaft. The flexible stationary seal is joined and separated with respect to said annular rotating seal at an upper end. At a middle portion a resilient portion is connected to a cylindrical vertical sliding member. A lower end of the flexible stationary seal is fixed to a disk-like substrate fixed continuously to a pump casing. The movable magnets are displaced by centrifugal force imparted due to rotation of the rotary base member and are disposed in the rotary base member with the annular rotating seal. The stationary magnets are disposed on the upper-surface side of the vertical sliding member.

When the motor rotating shaft is stopped, the N-poles or S-poles of the movable magnets are at their original positions, attracting an opposite pole of the stationary magnet such that the vertical sliding member is urged upward. Thus, the upper surface of the flexible stationary seal contacts a lower surface of the rotating seal to seal an air chamber. Alternatively, when the motor rotating shaft is rotating at a predetermined number of rotations, the pair of sealing members are controlled and the movable magnet is displaced from its original position by centrifugal force for the to repel each other and the vertical sliding member to be depressed downward. Therefore, the upper surface of the flexible stationary seal is separated from the lower surface of the rotating seal to release the seal of the air chamber.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Now, a liquid pump according to the present invention will be described in detail according to the attached drawings.

Figure 1:
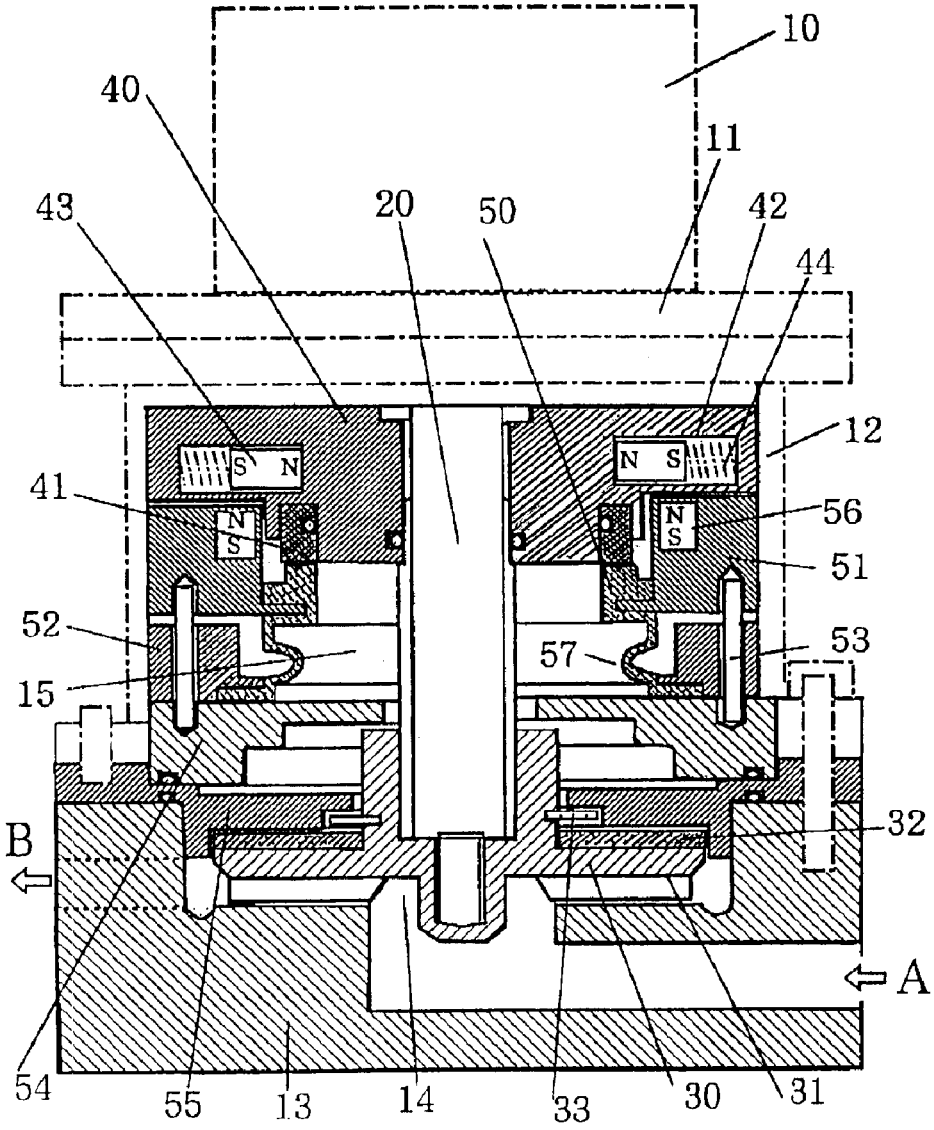
FIG. 1 is a side elevational view in section of a liquid pump assembly and sealing mechanism of the present invention.

In FIG. 1, a motor casing 10, in which an electric motor for driving a pump is disposed in a watertight condition. The motor casing 10 includes a bottom portion coupled to a cylindrical frame 12 for a pump by a flange 11. A pump casing 13 is attached in a fixed condition to the lower end of the cylindrical frame 12.

A motor rotating shaft 20 of the electric motor assembled in the motor casing 10 in an airtight condition is extended below the flange 11. A tip of the motor rotating shaft 20 reaches a pump chamber 14, and an impeller 30 is attached.

At a lower-end side of the impeller 30, main vanes 31 are attached, and at an upper-end side, back vanes 32 are attached. Moreover, on the impeller 30, a brim shaped back-flow prevention seal 33 is disposed, and said back-flow prevention seal 33 has a function to prevent, in coordination with an opening portion of a partition plate 55, a liquid from suddenly intruding from the pump chamber 14 side when the rotating shaft 20 is stopped.

When the impeller 30 is rotated by driving of the electric motor, suction is produced by effects of the main vanes 31 and back vanes 32 disposed therein. The liquid is suctioned from the direction of arrow A into a pump chamber 14 and is discharged in the direction of arrow B.

The above-described construction is basically identical to the construction of conventional, well-known liquid pumps. Now, a sealing mechanism will be described in detail.

At a position above the pump chamber 14 and in the interior enclosed by the cylindrical frame 12, the sealing mechanism is assembled.

A central opening of a base member 40 receives and to the rotating shaft 20. The lower surface of the rotary base member 40, which rotates in accordance with the rotation of the rotating shaft 20, has a rotating seal 41 attached. Although the basic shape of the rotating seal 41 is a ring or annular shape, the shape of its section is not necessarily rectangular as shown in FIG. 1. Nevertheless, since the rotating seal 41 is designed to perform sealing, it is necessary that at least the lower-side surface thereof has a part to closely fit to the upper surface of a flexible stationary seal 50 (which will be described later).

As a material to form the rotating seal 41, various materials generally used as sealing members, such as natural or synthetic rubber and synthetic resin, can be used. In general, a material having resistance to oil and other chemical agents, etc., is preferable. However, this depends on the application field of the liquid pump.

The flexible stationary seal 50 is disposed opposite to the aforementioned rotating seal 41. "Flexible" for the flexible stationary seal 50 means that, in FIG. 1, the whole or a part thereof is flexible in the up-and-down direction. "Stationary" means that the seal is independent of the rotating shaft 20 and does not rotate. It is satisfactory that the flexible stationary seal 50 used in the present invention is constructed so as to join and separate with respect to the rotating seal 41.

A protrusion formed on the side surface of the flexible stationary seal 50 of the present embodiment is attached to the inner wall of a disk-like vertical sliding member 51 by utilizing elasticity, while the lower-end portion of the flexible stationary seal 50 is fixed to a disk-like fixing member 52. The fixing member 52 is utilized to fix the lower end of the flexible stationary seal 50 attached on a disk-like substrate 54. The substrate 54 is fixed on the upper surface of the disk-like partition plate 55 for partition between the pump chamber 14 and an air chamber 15. Accordingly, the respective members, in a fixed condition with respect to the flexible stationary seal 50, are free from rotation of the rotating shaft 20 and do not rotate.

The vertical sliding member 51 is restricted by turn prevention bolts 53. Consequently, vertical sliding member 51 does not turn, and can shift in only the up-and-down direction by sliding along the turn prevention bolts 53.

The above construction is characterized in that it is unnecessary to slide the fixing member 52 and disk-like substrate 54 that support the flexible stationary seal 50 along the inner surface of the cylindrical frame 12. The vertical sliding member 51 is continuously provided from the flexible stationary seal 50 and has at a sliding surface with respect to other members including the inner surface of the cylindrical frame 12. No sealing mechanism such as an O-ring or a mechanical seal or the like as is found in a sealing mechanism of a prior liquid pump.

The flexible stationary seal 50 has an elastic portion 57 whose section is U-shaped and has, consequently, elasticity in the up-and-down direction. The elastic portion 57 can be constructed in various shapes such as a bellows shape in which a plurality of U-shaped portions are continued, and accordingly, the sectional shape of the flexible stationary seal 50 including the elastic portion 57 is not limited to that as shown in FIG. 1.

The flexible stationary seal 50 may be formed of a material having flexibility such as natural or synthetic rubber or synthetic resin, or it may employ a combined structure in which only the part of the elastic portion 57 is formed of a flexible member. Accordingly, for example, the elastic portion 57 may be formed of a stainless steal bellows. Furthermore, similar to the above-described rotating seal 41, it is generally preferable that the flexible stationary seal 50 is formed of a material having resistance to oil and other chemical agents, etc., and it is also preferable to enhance the chemical resistance by processing the front surface by a fluorocarbon resin treatment.

Now, a description will be given of a joining (contact) structure between the lower surface of the rotating seal 41 and the upper surface of the flexible stationary seal 50. Hereinafter, the term "contact" will be used for "joining."

Since these surfaces have a structure in which when the lower surface of the rotating seal 41 and the upper surface of the flexible stationary seal 50 are in contact, the seal is in an ON state. When both are separated, the seal turns OFF. The contact surfaces of both may be basically flat and smooth. Nevertheless, when a condition where the rotating shaft 20 is rotating at a predetermined number of rotations, a condition where the same is rotating below the predetermined number of rotations, and a condition where the same is stopped are compared, there is a difference in pressure of the air chamber 15 (the space from the back-flow prevent seal 33 to the rotary base member 40 and rotating seal 41). The inner pressure of the air chamber 15 becomes maximum when the rotating shaft 20 is stopped. Accordingly, it is preferable to construct the contact surfaces of both so that the contact state between the lower surface of the rotating seal 41 and the upper surface of the flexible stationary seal 50 becomes strongest when the inner pressure of the air chamber is maximized.

Figure 5:
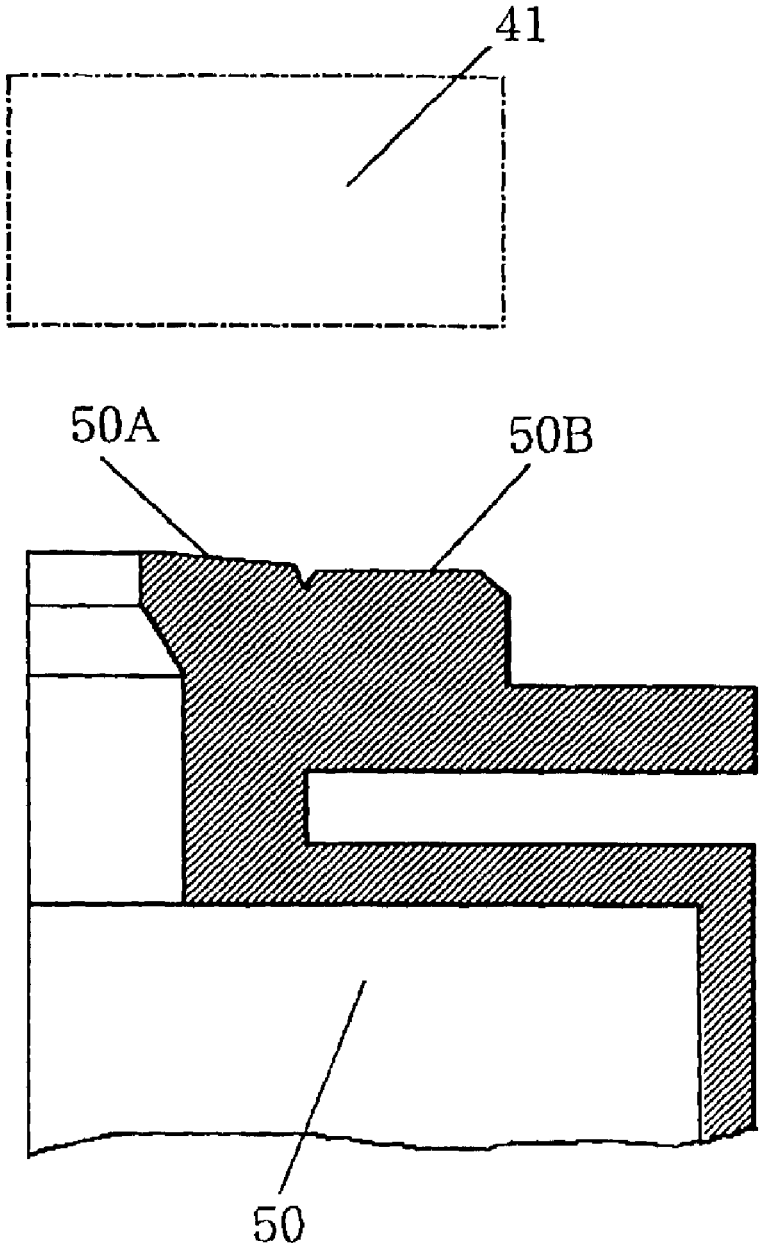
FIG. 5 is a partial side elevational view in section of a main part showing the contact surfaces of the annular rotating seal and flexible stationary seal.

A construction to satisfy the above will be described in detail. First, in the construction as shown in FIG. 5, the upper surface of the flexible stationary seal 50 is formed with two stages, having a shape wherein an upper-surface inner-peripheral side 50A is inclined toward the outer periphery and an upper-surface outer-peripheral side 50B is approximately horizontally formed. The tip of the upper-surface inner-peripheral side 50A is protruded from the surface of the upper-surface outer-peripheral side 50B. Accordingly, from the state where the rotating seal 41 and the flexible stationary seal 50 are separated, as driving of the pump is stopped and the number of rotations of the rotating axis 20 is decreased, the flexible stationary seal 50 rises due to the effects of magnets 43 and 56. Consequently, when the forefront tip portion of the upper-surface inner-peripheral side 50A comes in contact with the lower surface of the rotating seal 41, the flexible stationary seal 50 is further attracted upward by the force of the magnets 43 and 56, and the forefront tip portion of the upper-surface inner-peripheral side 50A is deformed and the surface of the upper-surface outer-peripheral side 50B comes in contact with the lower surface of the rotating seal 41.

Although the above construction employs a mode where the upper surface of the flexible stationary seal 50 is formed with two stages, any construction may be employed as long as close fitting is possible, such as a mode where the whole upper surface is formed in an inclined manner descending toward the outside (an umbrella shape).

Since the upper surface of the flexible stationary seal 50 has the above construction, even when the lower surface of the rotating seal 41 has a plane shape, a strong contact pressure can be obtained compared to a construction wherein the whole upper surface of the flexible stationary seal 50 is a plane. Thus, the sealing effect is high.

In the rotary base member 40 to which the rotating seal 41 is attached, magnet housing 42 contains movable magnets 43. In the vertical sliding member 51, disposed on the side surface of the flexible stationary seal 50, the stationary magnet 56 is disposed in magnet housing.

Figure 2:
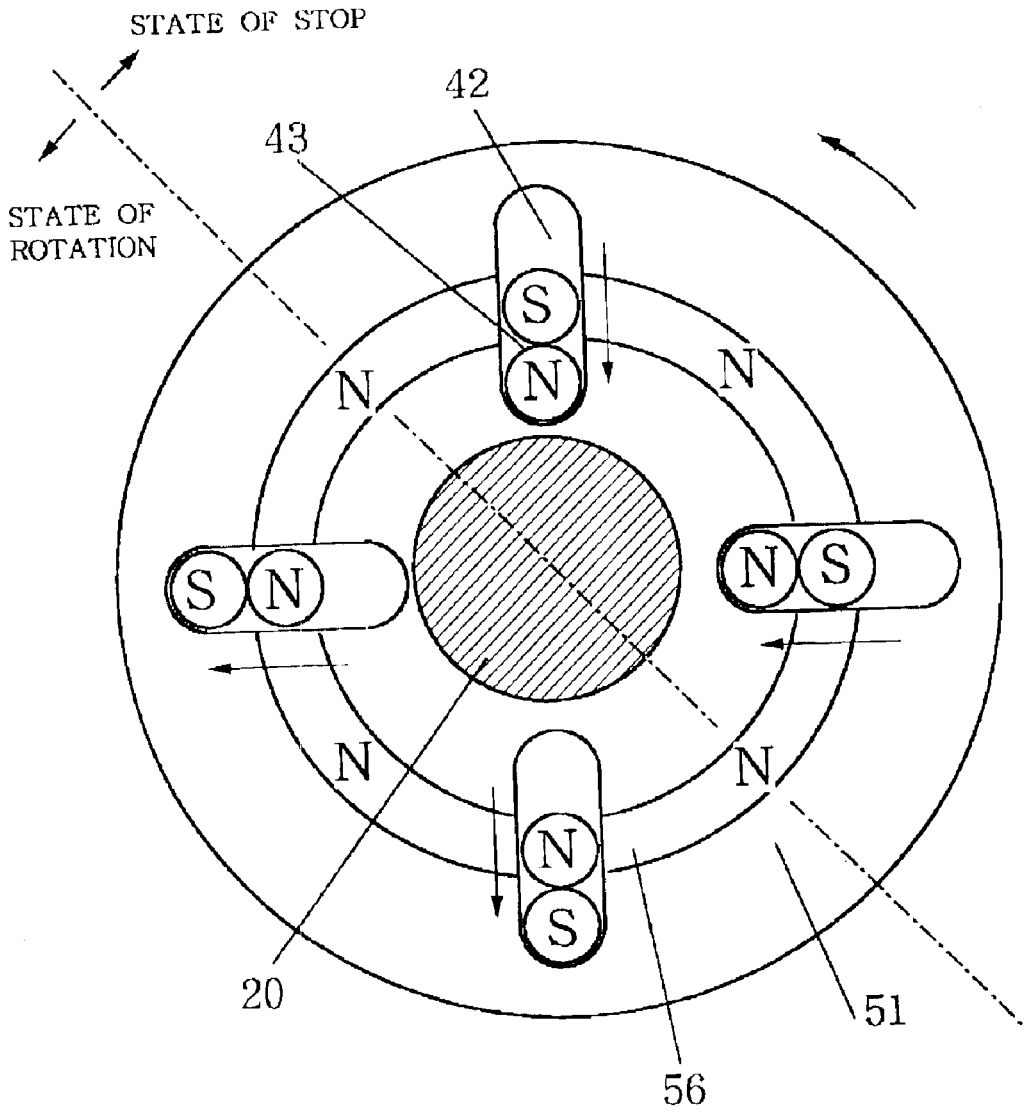
FIG. 2 is an enlarged top plan view in partial section illustrating the movable magnets.

As shown in FIG. 2, the movable magnets 43 are assembled in the magnet housings 42 in a radial direction in the rotary base member 40 and laid out so that the respective N-poles are located on the center side. Although the movable magnets 43 are arranged at four locations in the illustrated mode, the quantity is not limited. A stick-shaped single magnet is basically employed; however, the shape and quantity are not limited hereto and, for example, the mode may be such that two rectangular magnets are disposed so as to have mutually opposite polarities.

As shown in FIG. 2, the section of the stationary magnet 56 disposed in the vertical sliding member 51 has an annular shape, is arranged so that its N-pole is located upward, and corresponds to the movable magnets 43 disposed in radial direction. Herein, the movable magnets 43 and the stationary magnet 56 may be disposed so that the respective polarities become opposite to those shown in FIG. 2.

In the mode shown in FIG. 2, the magnet housing 42 for the movable magnets 43 are linearly disposed in the direction of circumference. The present invention includes, as shown in FIG. 3, a mode wherein the magnet housing 42 are prepared in a manner inclining in an opposite direction to the directions shown by the arrows.

Figure 3:
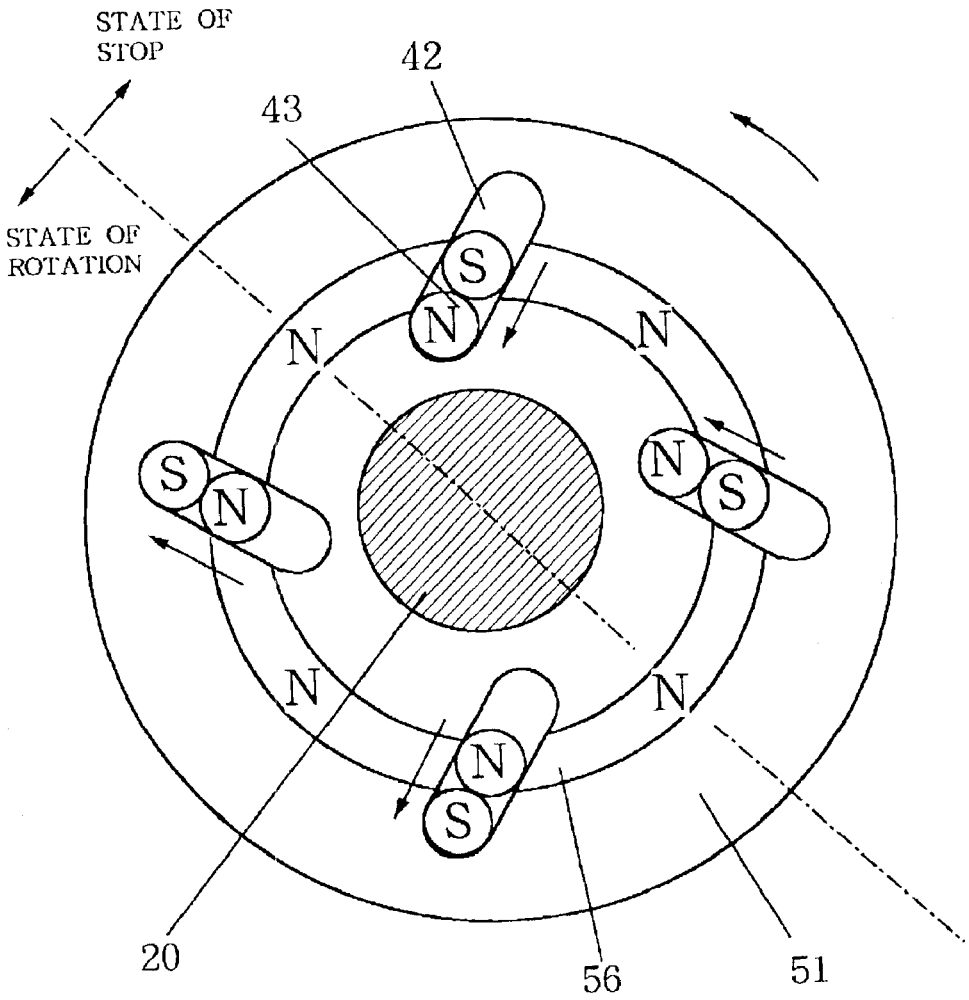
FIG. 3 is an enlarged top plan view in partial section illustrating another embodiment for the movable magnets.

As shown in FIG. 2 and FIG. 3, when the rotating shaft 20 is stopped (including the condition where the number of revolutions is below a predetermined number of rotations), that is, when the movable magnets 43 and the stationary magnet 56 are in the positional condition as shown in FIG. 1, the S-poles of the movable magnets 43 and the N-pole of the stationary magnet 56 attract each other, and consequently, the vertical sliding member 51 is attracted in the upper direction in FIG. 1. The upper surface of the flexible stationary seal 50 is brought into contact with the lower surface of the rotating seal 41, and the sealing function turns ON.

Figure 4:
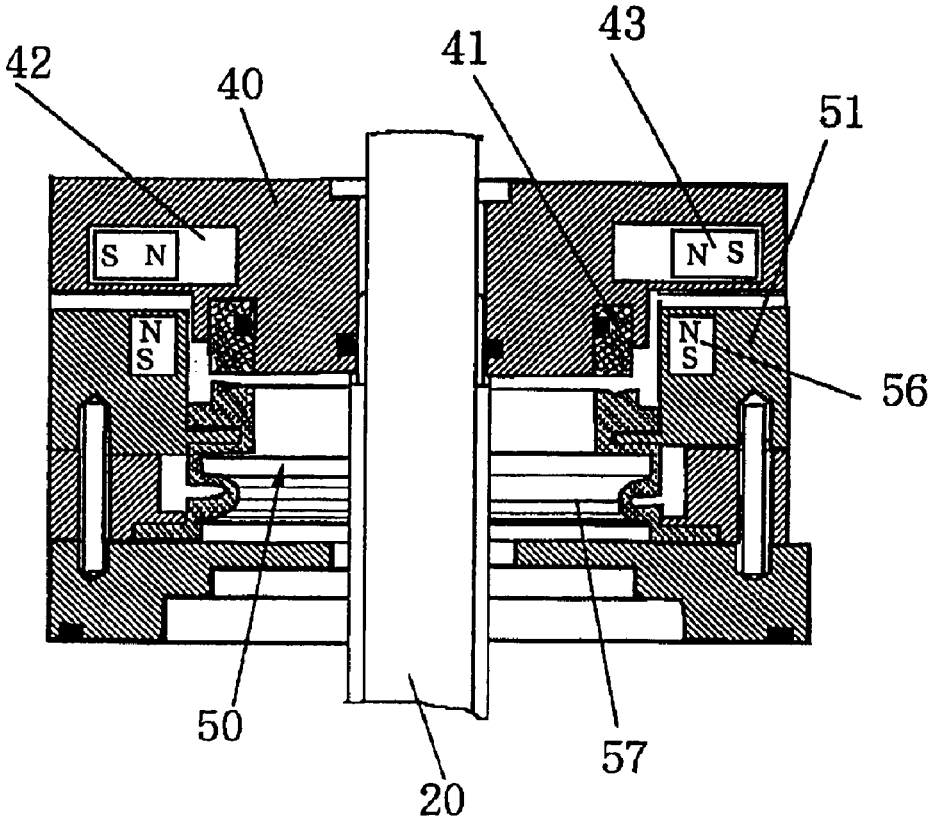
FIG. 4 is a partial side elevational view in section of the liquid pump assembly of FIG. 1 illustrating the sealing mechanism in the OFF state.

Next, when the rotating axis 20 is rotating at a predetermined number of rotations, the rotary base member 40 is also simultaneously rotated, and therefore, the movable magnets 43 are urged in the direction of circumference by centrifugal force; and their N-poles are located on the upper surface of the N-pole of the stationary magnet 56 prepared in the vertical sliding magnet 51 (see the rotating conditions of FIG. 2 and FIG. 3). In this condition, the N-poles of the movable magnets 43 and the N-pole of the stationary magnet 56 repel each other. Consequently, the vertical sliding member 51 is depressed in the lower direction as shown in FIG. 4. As a result, contact of the upper surface of the flexible stationary seal 50 with the lower surface of the rotating seal 41 is released, and the sealing function turns OFF.

In the above construction, it is necessary to give a description of a mechanism whereby the movable magnets 43, which were urged in the direction of circumference by centrifugal force when the rotating shaft 20 was rotating at the appointed number of rotations, are returned to the original positions as shown in FIG. 1, when the rotating shaft 20 stops (including when the rotating shaft 20 is rotating at a number of rotations less than the appointed number of rotations).

As a first mode to enable the above-described mechanism, a construction can be mentioned, wherein at a point in time where rotation of the rotating shaft 20 is stopped and the centrifugal force which urged out the movable magnets 43 in the direction of circumference is weakened, an attracting force whereby the S-poles of the movable magnets 43 and the N-pole of the magnet 56 attract each other becomes great. Therefore, the movable magnets 43 automatically return to the original positions.

As a second mode, a construction can be mentioned, wherein, as shown by the virtual lines in FIG. 1, the movable magnets 43 automatically return to the original positions by utilizing repulsion of an elastic member 44 such as a helical spring or rubber. It may be a construction, wherein the repulsion of this elastic member 44 and the repulsive and attractive magnetic forces of the magnets 43 and 56 are utilized together.

As a third mode, a construction can be mentioned, wherein the movable magnets 43 are returned by their own gravity when the magnet housing 42 for storing the movable magnets 43 are disposed in a manner inclining in the center direction and no load of centrifugal force exists. This mode is effective only when a liquid pump is utilized while a vertical condition is maintained at all times.

When the flexible stationary seal 50 is utilized in combination with the rotating seal 41, effects as described above are provided. The sealing member is characterized in that the whole body is cylindrical. At the upper and lower end portions and the side surface portion, connecting portions to the stationary and movable members are formed. At the middle portion, an elastic portion is formed according to the present invention and can be utilized as a flexible sealing member to divide an inner space of a cylindrical object into two in the longitudinal direction for a pump, such as a liquid pump and other flexible seal purposes in various fields.

Now, second and third embodiments of the present invention will be described according to FIGS. 6*a* and 6*b*.

Figure 6A:
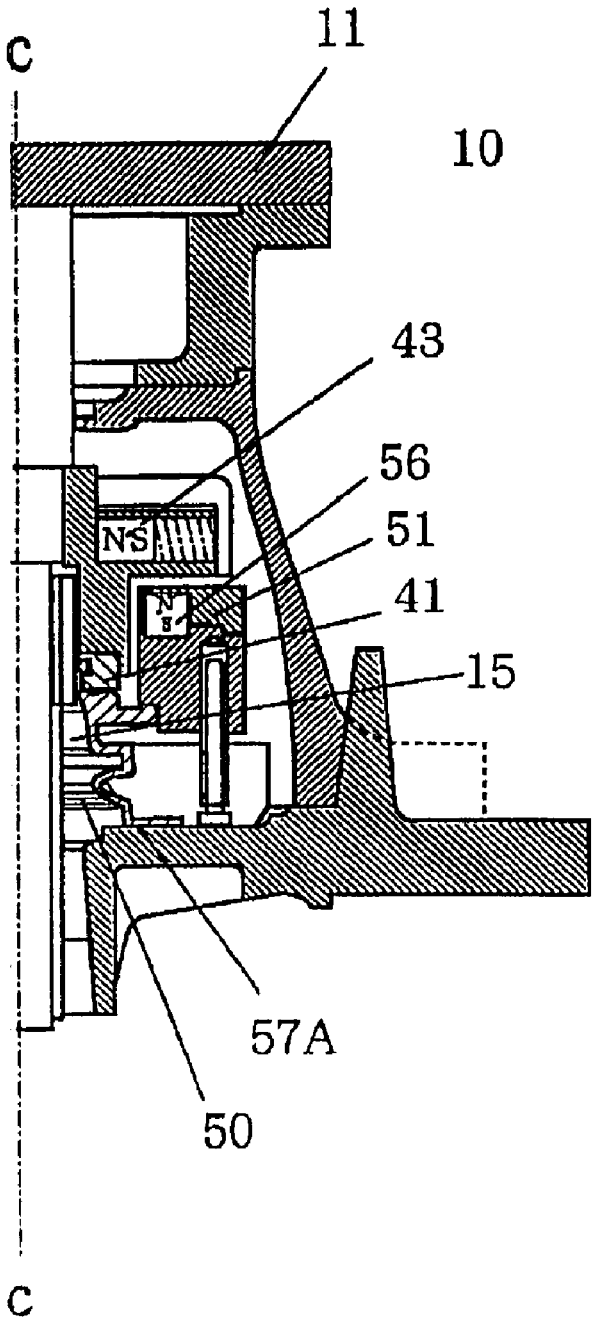
FIG. 6*a* is a partial side elevational view in section of the liquid pump assembly according to a second embodiment of the present invention.
Figure 6B:
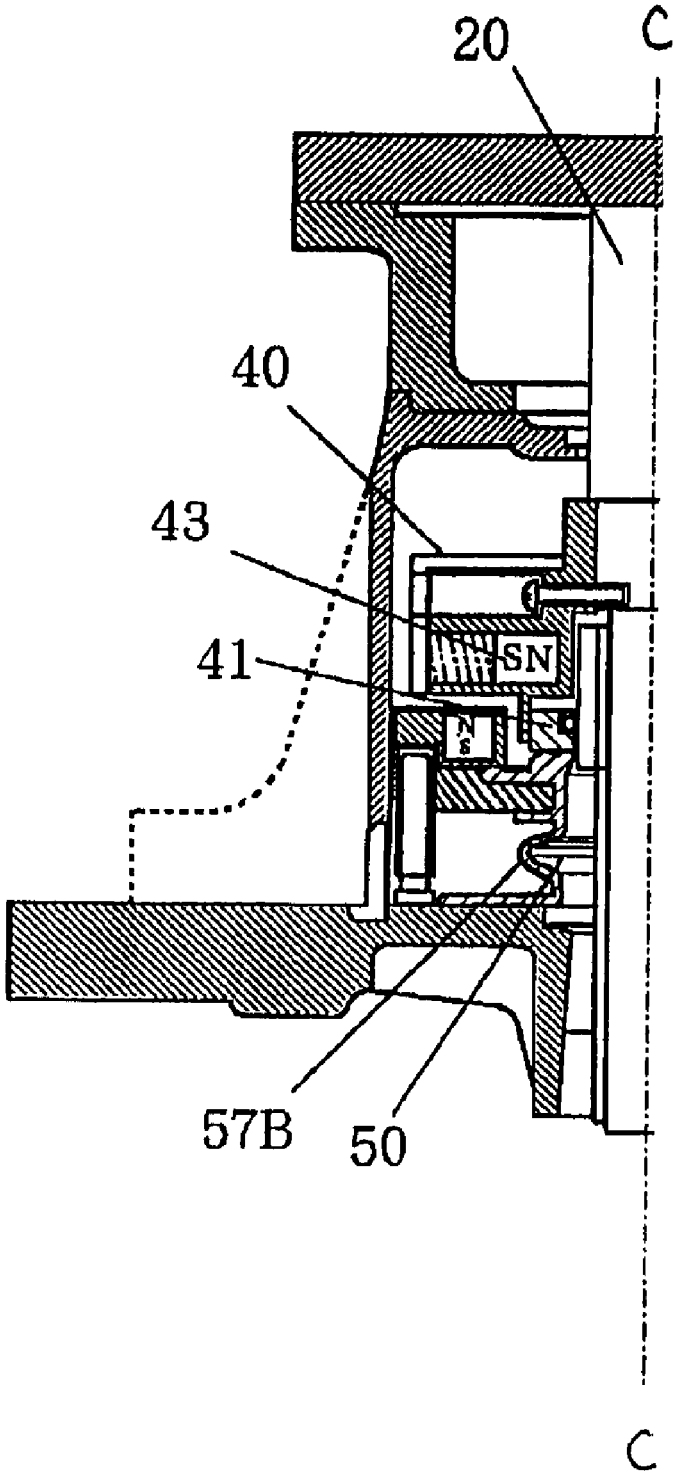
FIG. 6*b* is a partial side elevational view in section of the liquid pump assembly according to a third embodiment of the present invention.

Another more advanced mode of the invention is expressed in the third embodiment of FIG. 6*b*, and has the following advantages compared with the mode expressed in the second embodiment of the FIG. 6*a*. The first advantage is in a construction of the elastic portion 57A provided for the flexible stationary seal 50. The elastic portion 57B expressed in the 6*a* is formed in an inwardly bending shape; whereas the elastic portion 57A expressed in the 6*b* is formed in an outwardly bending (swelling) shape. The difference in the shapes between the two displays a difference in capacities to absorb the pressure of the pump chamber side. As mentioned above, when the number of rotations of the motor rotating shaft 20 is gradually decreased and the motor rotating shaft 20 reaches a stopped condition, the inner pressure of the air chamber 15 (as shown in FIG. 1, the inner space from the back-flow prevent seal 33 to the rotary base member 40 and rotating seal 41) is maximized. At this time, the pressure of the air chamber 15 directly effect the sealing structure which functions at the contact surfaces between the lower surface of the rotating seal 41 and the upper surface of the flexible stationary seal 50. If the pressure of the air chamber 15 is excessively heightened, the sealing structure may finally be broken.

As described above, even if the pressure of the air chamber 15 is excessively heightened, since the elastic portion 57A has an outwardly swiveling structure in the mode expressed in FIG. 6*b*, the excessively high pressure of the air chamber 15 effects the elastic portion 57A, functions as if to blow up a balloon. Therefore, the pressure is quickly absorbed. Accordingly, compared with the mode expressed in FIG. 6*b*, in which a high pressure directly effects at the sealing structure that functions at the contact surfaces between the lower surface of the rotating seal 41 and the upper surface of the flexible stationary seal 50, the seal easily turns OFF even with a weak repulsive magnetic force when the rotating seal 41 rotates at restarting.

In the mode shown in FIG. 6*a*, since the elastic portion 57A is curved inward, its capacity to absorb an inner pressure rapidly increased at stopping is weak. On the other hand, a high pressure is exerted to the sealing structure that functions at the contact surfaces between the lower surface of the rotating seal 41 and the upper surface of the flexible stationary seal 50. As a result, sealing ability is improved. Nevertheless, this aspect also results in that if the repulsive force between the movable magnets 43 and stationary magnet 56 is weak at restarting, the contact surfaces between the lower surface of the rotating seal 41 and the upper surface of the flexible stationary seal 50 are not easily separated and the sealing condition remains ON. Consequently, a burden is exerted on rotation of the rotating shaft 20.

Next, capacity of the space formed around the contact surfaces between the lower surface of the rotating seal 41 and the upper surface of the flexible stationary seal 50, or the positional relationship between the movable magnet 43 and stationary magnet 56 comes into question.

In the mode expressed in FIG. 6*a*, with respect to the rotary base member 40 on which the movable magnets 43 are disposed, a vertical sliding portion 51 which is structured to move in the up-and-down direction with long strokes and has a stationary magnet 56 on its upper-end side is disposed. A space with a large capacity is formed outside the sealing structure that functions at the contact surfaces between the lower surface of the rotating seal 41 and the upper surface of the flexible stationary seal 50. In contrast thereto, in the mode expressed in FIG. 6*b*, the movable magnets 43 and the stationary magnet 56 are disposed close to the sealing structure, and capacity of the space formed outside the sealing structure is small. Accordingly, even if liquid leakage occurs outside the sealing structure, in the mode expressed in FIG. 6*b*, the quantity of liquid leakage can be limited to as little as possible.

The third characteristic point is already obvious from the above description. Namely, compared to that the vertical movement stroke of the vertical sliding member 51 to support the stationary magnet 56 is long in the mode expressed in FIG. 6*a*, ON/OFF of the sealing structure is operated with very short vertical movement strokes in the mode expressed in FIG. 6*b*. The difference between the two is a difference in responding quickness (strength) of the stationary magnet 56 which repulses the polarity of the movable magnets 43 and is, furthermore, displayed as ease in fine adjustment of the magnets, etc.

Figure 7:
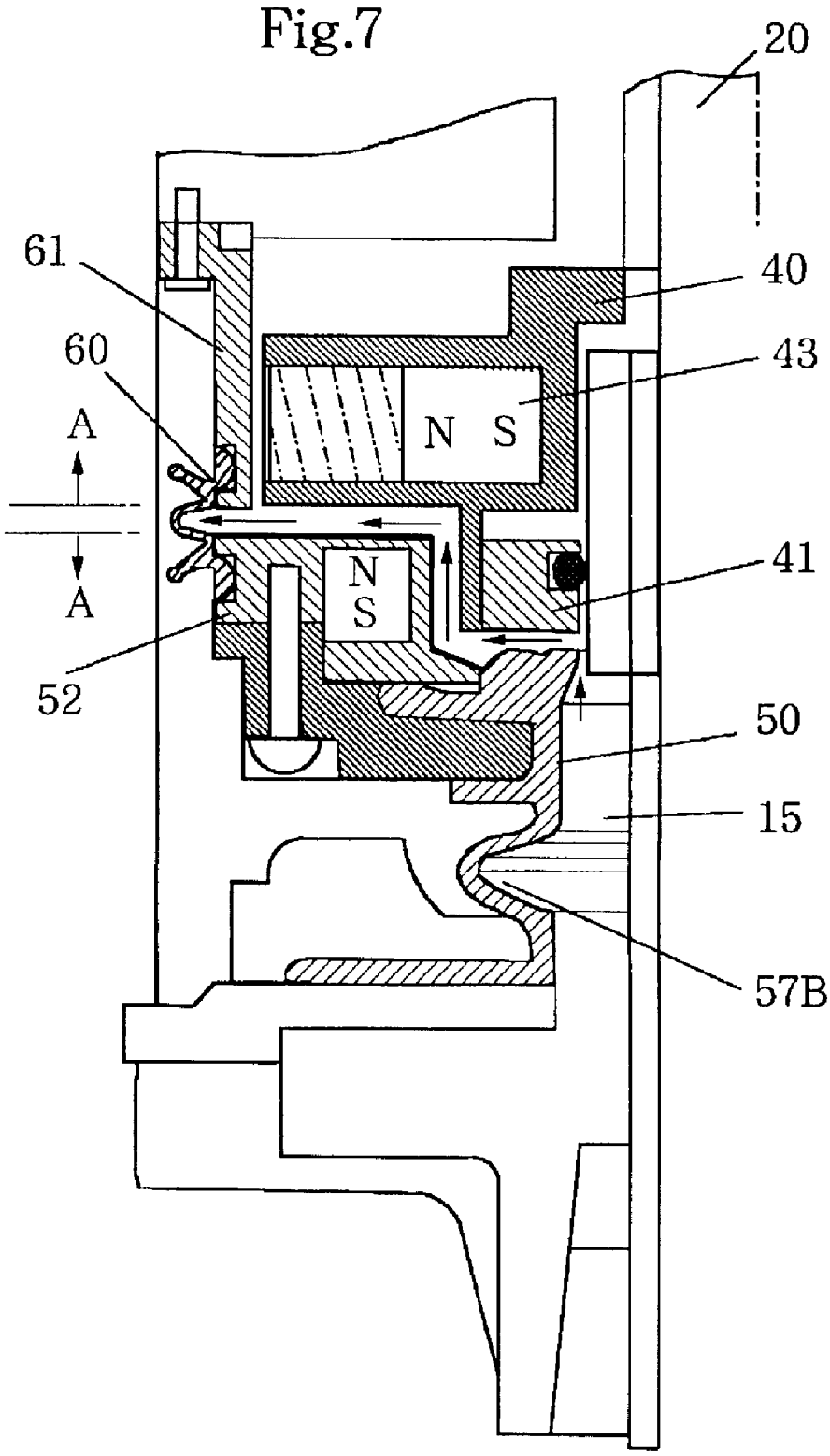
FIG. 7 is a partial side elevational view in section of the liquid pump assembly according to a fourth embodiment of the present invention.

A fourth embodiment of the present invention is shown in FIG. 7 and will now be described. This embodiment is characterized in a structure wherein an annular sealing member shown by a symbol 60 is arranged between the upper-end marginal portion of the fixing member 52 and a cylindrical attachment member 61 arranged outside the rotary base member 40. Namely, this annular seal 60 is made to respond to the movement of the sealing structure composed of the rotating seal 41 and flexible stationary seal 50 and is structured, as illustrated, so as to be separated in the arrow direction A—A. When the rotating shaft 20 is rotating and the sealing structure is OFF, it can then be operated in reverse to the arrow direction A—A and reach a compressed state when the rotation of the rotating shaft 20 is stopped and the sealing structure is ON, such that the flow channel shown by the arrows is closed.

The above structure is a safety mechanism which is caused to function as a reserve in a case where the sealing structure composed of the rotating seal 41 and the flexible stationary seal 50 did not function even when rotation of the rotating shaft 20 was stopped. Therefore, it is not a necessary construction in all embodiments.

Since a liquid pump according to the present invention has the above-described construction, advantages are provided such that (1) the sealing members can be controlled so as to be separated when the rotating shaft is in operation and so as to function only when the rotating shaft is not in operation; therefore, the members are effectively prevented from wearing down compared with the prior construction in that the members are in operation at all times; (2) a constant voltage source is unnecessary for seal control; therefore, the liquid pump can be utilized in countries and regions where voltage are variable; (3) ON/OFF of the sealing members are carried out by only the action of magnets that are mechanically out of contact, and the magnet housing can easily maintain watertight-ness; (4) sealing of the part for driving the sealing members is unnecessary, contamination of the O-ring or mechanical seal part as in the prior sealing mechanism does not occur, and the maintenance burden is relieved; and (5) the number of components is small, the mechanism is simple, and manufacturing costs can be reduced.

While various embodiments have been chosen to illustrate the invention, it will be understood by those skilled in the art that various changes and modifications can be made without departing from the scope of the invention as defined in the appended claims.

What is claimed is:

1. A liquid pump assembly, comprising:

a motor casing for an electric motor having a cylindrical frame;

a rotating motor shaft extending from said casing;

a rotary base member fixed to said rotary shaft and having a lower surface;

a pump casing attached to said cylindrical frame and having a pump chamber enclosed in a watertight manner by said cylindrical frame;

a vertically sliding member between said rotary base member and said pump casing, and having an upper surface;

an impeller fixed to a tip of said rotating shaft and located in said pump chamber; and a sealing mechanism disposed in an air chamber between said motor casing and said pump casing, said sealing mechanism including an annular rotating sealing member and a flexible stationary sealing member disposed around said rotating shaft and including movable and stationary magnets with N-poles and S-poles opening and closing said sealing mechanism by joining and separating said sealing members, respectively, by magnetic force of said magnets, said rotating sealing member being attached to said lower surface of said rotary base member, said stationary sealing member being fixed on said upper surface of said vertically sliding member, said movable magnets being disposed and displaceable in said rotary base member by centrifugal force created by rotation of said rotating shaft and said rotary base member, said stationary magnet being disposed on said upper surface of said vertically sliding member;

whereby, when said rotating shaft is stopped, one pole of said movable magnet is in a stopped position adjacent an opposite pole of said stationary magnet to attract and move said vertically sliding member upwardly until upper surface of said flexible stationary sealing member contacts a lower surface of said annular rotating sealing member to seal said air chamber; and whereby said rotating shaft is rotating at least a predetermined number of rotations, said pair of sealing members are controlled so that the same poles of said movable magnet is displaced from said stopped position by centrifugal force, such the pole of said stationary magnet repels the pole of said movable magnet to depress said vertically sliding member downward, and to separate said upper surface of said stationary seal from said lower surface of said annular rotating seal to unseal said chamber.

2. The liquid pump assembly according to claim 1 wherein said movable magnet is returnable to the stopped position by a repulsive force between the same poles of said magnets and an attractive force of opposite poles of said magnets.

3. The liquid pump assembly according to claim 1 wherein said stationary sealing member has a substantially cylindrical body including an upper portion with said upper surface of said stationary sealing member having an inner periphery and an outer periphery, a lower portion, and a connecting portion, coupling said upper and lower portions.

4. The liquid pump assembly according to claim 3 wherein said connecting portion is resilient.

5. The liquid pump assembly according to claim 3 wherein said inner periphery is inclined towards said outer periphery; and said outer periphery is horizontal.

6. The liquid pump assembly according to claim 3, wherein the connecting portion has an outwardly curved shape.

7. The liquid pump assembly according to claim 3 wherein the connecting portion has an inwardly curved shape.

8. The liquid pump assembly according to claim 1 wherein an annular seal is connected between a upper-end margin of a fixing member housing said stationary magnet and an end portion of a cylindrical attachment member mounted outside of said rotary base member.

9. A liquid pump assembly, comprising:

a motor casing for an electric motor having a cylindrical frame;

a rotating motor shaft extending from said casing;

a rotary base member fixed to said rotary shaft and having a lower surface;

a pump casing attached to said cylindrical frame and having a pump chamber enclosed in a watertight manner by said cylindrical frame;

a vertically sliding member between said rotary base member and said pump casing, and having an upper surface;

a substrate attached to said pump casing;

an impeller fixed to a tip of said rotating shaft and located in said pump chamber; and a sealing mechanism disposed in an air chamber between said motor casing and said pump casing, said sealing mechanism including an annular rotating sealing member and a flexible stationary sealing member disposed around said rotating shaft and including movable and stationary magnets with N-poles and S-poles opening and closing said sealing mechanism by joining and separating said sealing members, respectively, by magnetic force of said magnets, said rotating sealing member being attached to said lower surface of said rotary base member, said stationary sealing member being fixed on said upper surface of said vertically sliding member and attached to a top surface of said substrate, said movable magnets being disposed and displaceable in said rotary base member by centrifugal force created by rotation of said rotating shaft and said rotary base member, said stationary magnet being disposed on said upper surface of said vertically sliding member;

whereby, when said rotating shaft is stopped, one pole of said movable magnet is in a stopped position adjacent an opposite pole of said stationary magnet to attract and move said vertically sliding member upwardly until upper surface of said flexible stationary sealing member contacts a lower surface of said annular rotating sealing member to seal said air chamber; and whereby said rotating shaft is rotating at least a predetermined number of rotations, said pair of sealing members are controlled so that the same poles of said movable magnet is displaced from said stopped position by centrifugal force, such the pole of said stationary magnet repels the pole of said movable magnet to depress said vertically sliding member downward, and to separate said upper surface of said stationary seal from said lower surface of said annular rotating seal to unseal said chamber.

10. The liquid pump assembly according to claim 9 wherein said movable magnet is returnable to the stopped position by a repulsive force between the same poles of said magnets and an attractive force of opposite poles of said magnets.

11. The liquid pump assembly according to claim 9 wherein said stationary sealing member has a substantially cylindrical body including an upper portion with said upper surface of said stationary sealing member having an inner periphery and an outer periphery, a lower portion, and a connecting portion, coupling said upper and lower portions.

12. The liquid pump assembly according to claim 11 wherein said connecting portion is resilient.

13. The liquid pump assembly according to claim 11 wherein said inner periphery is inclined towards said outer periphery; and said outer periphery is horizontal.

14. The liquid pump assembly according to claim 11, wherein the connecting portion has an outwardly curved shape.

15. The liquid pump assembly according to claim 11 wherein the connecting portion has an inwardly curved shape.

16. The liquid pump assembly according to claim 9 wherein and annular seal is connected between a upper-end margin of a fixing member housing said stationary magnet and an end portion of a cylindrical attachment member mounted outside of said rotary base member.

* * * * *